United States Patent [19]

Hunt

[11] 4,090,269

[45] May 23, 1978

[54] INSULATED COVERING

[75] Inventor: Harry E. Hunt, Chicago, Ill.

[73] Assignee: Alpine Designs, Inc., Boulder, Colo.

[21] Appl. No.: 662,355

[22] Filed: Mar. 1, 1976

[51] Int. Cl.[2] ..... A47G 9/00

[52] U.S. Cl. ..... 5/343; 2/69.5

[58] Field of Search ..... 112/420; 160/199; 5/343, 334 R; 2/69.5

[56] References Cited

U.S. PATENT DOCUMENTS

| | | | |
|---|---|---|---|
| 1,393,975 | 10/1921 | Rowley | 112/420 |
| 1,465,767 | 8/1923 | Krause | 112/420 X |
| 3,334,363 | 8/1967 | Lutz | 5/343 |
| 3,878,574 | 4/1975 | Erickson | 5/343 |

*Primary Examiner*—Paul R. Gilliam
*Assistant Examiner*—David H. Corbin
*Attorney, Agent, or Firm*—John E. Reilly

[57] ABSTRACT

Insulated coverings, such as for example, sleeping bags, garments and the like are characterized by inner and outer coextensive layers of a fabric material having unidirectionally extending insulating plies therebetween wherein each of the insulating plies is composed of a compressible fill material having continuous filaments extending in a direction normal to the length of the plies whereby the insulating plies may serve the dual function of insulating and unifying the cover layers together in a unique manner.

14 Claims, 7 Drawing Figures

INSULATED COVERING

This invention relates to novel and improved insulated coverings, and more particularly relates to a novel and improved insulated covering construction which is especially adaptable for use in outer garments, sleeping bags and the like.

BACKGROUND OF THE INVENTION

Insulated coverings have been devised for various uses and are customarily comprised of outer fabric covers or shells secured together along their outer peripheral edges and containing some form of insulation sandwiched between the inner and outer layers. Generally, in designing an insulated covering which is to be used as a garment or sleeping bag an insulating material is employed which is readily compressible into a small space, for example, to permit its compact storage for hiking or camping purposes but should also possess the ability to loft or expand when spread out or worn, since the insulating characteristics of the covering are greatly enhanced by trapping large air spaces within and between the outer layers. On the other hand, utilization of materials, such as, down which possess high loft characteristics has presented certain problems from the standpoint of maintaining uniformity and thickness of the covering, or, in other words, to prevent undue shifting of the fill material into one section of the covering. For this reason, insulating coverings of the type referred to are generally quilted or formed into compartments so as to prevent movement or shifting of the insulating fill material. Typical of the quilted construction referred to are those set forth and described in my previously issued patents including U.S. Pat. Nos. 3,787,906 and 3,857,125 for sleeping bag constructions. In addition, my previously issued U.S. Pat. No. 3,805,720 for QUILTED CONSTRUCTION sets forth and describes an insulated covering in which a baffle layer is used in combination with an insulating material between inner and outer shell layers in order to form a compartmentalized covering specifically where the baffle layers extend in a somewhat zig-zag or V-shaped configuration and are joined to seam zones of the outer shell layer so as to form generally V-shaped tubes which may be filled with a resilient insulating fill material; for example, natural or artificial fibers, such as wool or polyester or materials, such as, duck down, goose down or the like.

Quilted constructions of the type referred to have generally achieved the desirable characteristics of a lightweight insulated covering which has a relatively high degree of compressibility to enable compact storage; yet in use will afford a substantial degree of expansion of loft. Nevertheless, it is highly desirable to minimize the number of steps required in the construction and assembly of insulated coverings in order to simplify their construction; also to reduce the effective volume and weight of insulating materials required while achieving the maximum degree of loft so as to provide for a covering which is lightweight and readily foldable or rolled into a small compact package.

SUMMARY OF THE INVENTION

It is therefore an object of the present invention to provide for a novel and improved insulating covering which is particularly adaptable for use in the design and construction of sleeping bags, garments and the like.

It is another object of the present invention to provide for an insulated covering which requires a minimum number of steps in construction and assembly as well as a substantial reduction in volume and weight of insulating material required.

It is a further object of the present invention to provide for a novel and improved insulated covering in which the insulating material is so composed, constructed and arranged as to obviate use of special baffle layers between the insulating material while avoiding shifting or relative movement of the insulating material between the outer shell or cover layers.

A still further object of the present invention is to provide an insulated covering readily conformable for use in various types of clothing, garments and the like which can be readily contoured and designed into different configurations while being extremely compact and possessing a maximum degree of loft for optimum insulation and protection of the body.

It is an additional object of the present invention to provide for a sleeping bag construction which is light in weight, sufficiently porous to permit release of moisture and adjustable to provide the desired degree of warmth as well as venting in the event of excess heat generated within the bag; and further wherein the bag is so constructed and arranged as to possess a maximum degree of loft for the thickness of insulating material employed.

It is a still further object of the present invention to provide for an insulated covering containing an insulating material arranged in the form of overlapping diagonal plies sandwiched and interconnected between the inner and outer fabric layers so as to be readily compressible into a compact package for storage or transportation but when spread or expanded will form large pockets of trapped air masses between the insulating plies to achieve in combination with the insulated material a maximum degree of insulation and warmth.

In accordance with the present invention there has been devised an insulated covering which is comprised essentially of inner and outer coextensive layers secured together along their outer peripheral edges and having a plurality or series of insulating plies interposed between the inner and outer coextensive layers in such a way that the plies are arranged in diagonally extending, overlapping relation to one another between the inner and outer layers with opposite side edges of the plies affixed to inner surfaces of the layers. In order to arrange the insulating material in the form of overlapping plies, preferably the insulating material is composed at least in part of continuous filaments oriented in the diagonal direction of extension of each ply from one side edge to the other so as to resist any undue stretching or misshaping of the covering; and additionally the opposite side edges of the insulating plies are arranged to extend diagonally between seam zones or abutting edges of the fabric strips making up the inner and outer coextensive layers of the covering. Depending upon the width of material comprising the inner and outer coextensive layers, the insulating plies may be arranged to extend from interconnection along one side edge to a seam extending along the inner layer diagonally for interconnection of an opposite side edges to the next one or two seams removed on the opposite or outer coextensive layer. In succession, each insulating ply is affixed to the next adjacent series of seams. Moreover, the seams are most desirably formed by tucking or folding inwardly and fastening to the opposite side edges of the insulating plies just inwardly of the plane of the outer coextensive layers somewhat in the manner disclosed between the baffle layers and seams as disclosed in my hereinbefore referred to U.S. Pat. No. 3,805,720. An important distinction in accordance with the present invention, apart from or in addition to the elimination of the baffle layers, is to provide for a series of spaced insulating plies which correspondingly run in diagonal spaced parallel relation to one another and have their opposite side edges interconnected to the abutting edges or seams in such a way as to contribute greatly to ease of compression or flattening of the covering when it is rolled or folded into a storage position. At the same time, the separation between plies permits them to loft or expand outwardly to a greater degree and to form large trapped air spaces between the plies when the covering is in use.

In the preferred form, the insulating plies are composed of a continuous filament fiber and preferably a polyester filamentary material in which continuous filaments run in a direction normal to the side or connecting edges of the insulating plies whereby to resist stretching in the direction of applied force normal to the side edges of the plies. One such material is manufactured and sold under the trademark POLARGUARD by Celanese Corporation of America and is a continuous filament, synthetic fiber which will form a stable layer of insulation possessing high loft characteristics comparable to down. In addition, interconnection of the insulating plies to the coextensive layers is such that in flattened condition each insulating ply will overlap one-half of each next successive ply so as to effectively provide a double layer of insulation of uniform thickness throughout the length and breadth of the covering.

When the insulated covering is constructed for use as a sleeping bag, the bag is comprised of one or more panel sections folded upon one another or otherwise arranged in superimposed relation where a panel section is defined by of inner and outer coextensive layers and each layer is made up of somewhat elongated strips extending laterally of or transversely to the length of the bag, the strips being secured together along abutting edges or seams. In turn, the insulating plies have their opposite side edges fastened to the abutting edges or seams as described so as to similarly extend transversely of the length of the bag and to overlap one another throughout the length and breadth of the bag. The insulating plies also lend themselves well to forming divided portions in the bag, such as a partially divided area for the feet or draft tubes which form insulating flaps along the zipper sections for increased comfort and warmth.

The foregoing and other objects, advantages and features of the present invention will be more apparent in view of the following detailed description when taken in conjunction with the following drawings, in which:

DETAILED DESCRIPTION OF THE PREFERRED EMBODIMENT

Figures 1, 2, 3, 4:
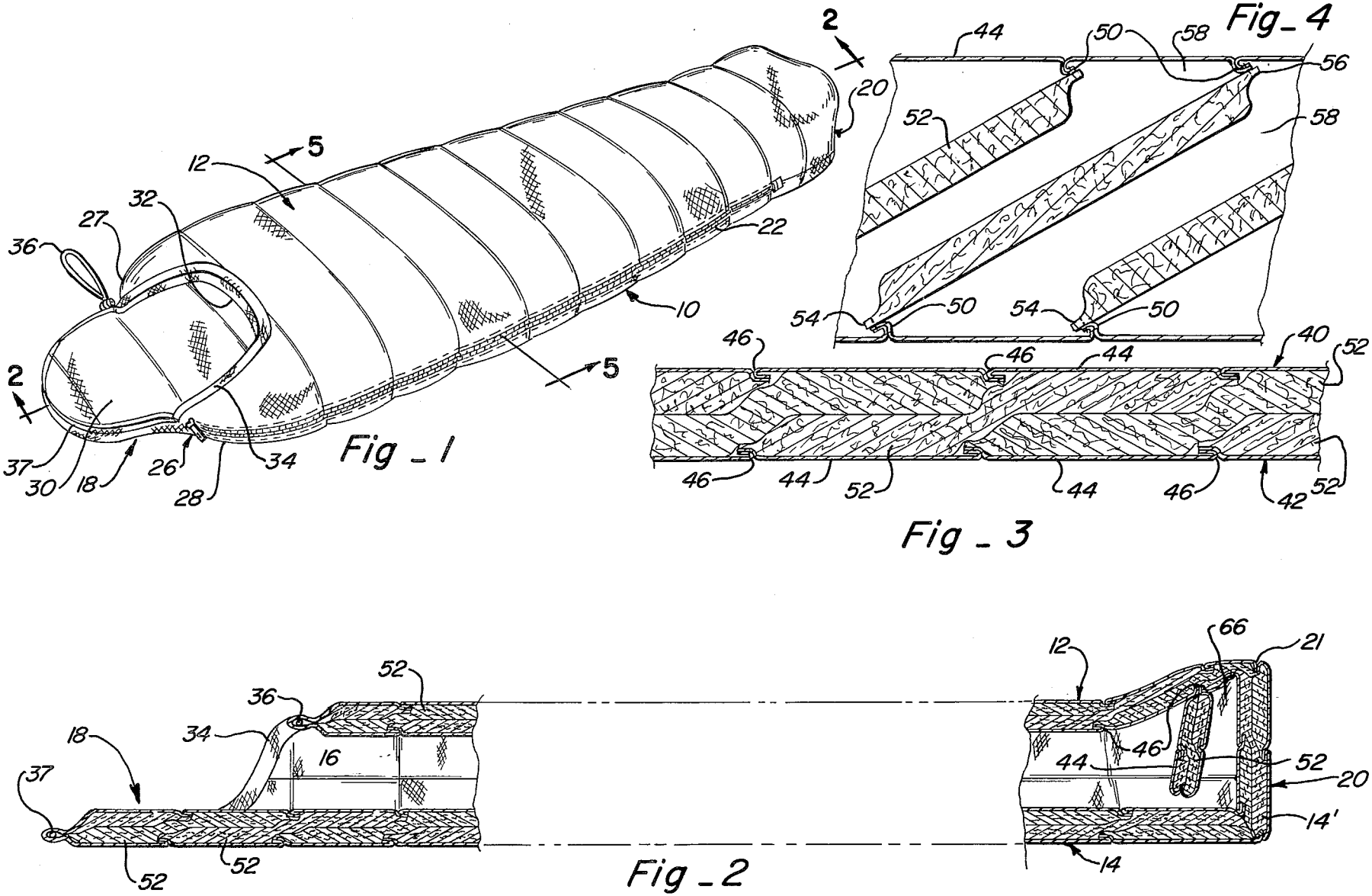
FIG. 1 is a somewhat perspective view of a sleeping bag incorporating an insulated covering in accordance with the present invention.
FIG. 2 is a cross-sectional view taken about lines 2—2 of FIG. 1.
FIG. 3 is an enlarged cross-sectional view of the insulated covering in a flattened condition.
FIG. 4 is an enlarged cross-sectional view taken in the same relation as FIG. 3 with the covering and insulating plies illustrated in a somewhat expanded condition.

Referring in detail to the drawings, there is shown by way of illustrative example in FIGS. 1 to 5 a preferred embodiment of a sleeping bag 10 which is of a type commonly referred to as a "mummy bag." As a setting for the present invention, the bag 10 is comprised of upper and lower panel sections 12 and 14. In use, the upper panel section is normally folded or doubled over the lower panel section 14 and joined together with the lower section along a common fold line defined by a longitudinal seam 16 which is reinforced with a longitudinal baffle layer 17 so that the bag is of substantially uniform thickness along the seam 16. The panel sections 12 and 14 are correspondingly tapered or reduced in width from the head portion 18 to the foot portion 20 and are joined together at the foot by a generally vertical extension 14' of the lower panel 14 which is turned or folded upwardly and joined to the upper panel along an upper seam 21. The opposite mating longitudinal side edges of the upper and lower panel sections 12 and 14 are releasably secured together by a zipper section 22 which extends for the greater length of the bag and terminates just short of the foot portion 18.

The upper and lower panel sections 12 and 14 are further contoured at the shoulder portions of the bag generally designated at 26 so as to curve sharply inwardly as at 27 and 28, the lower panel continuing into a hood portion 30 while the upper panel is recessed to form a generally U-shaped opening 32 which is reinforced around the edge by a tubular reinforcing portion or bead 34. A drawstring 36 may extend through the tubular reinforcing portion 36 and continue through another reinforcing portion 37 which circumscribes the hood portion 30. In this way, the drawstring may be tightened or drawn inwardly to form a limited generally circular opening to fully enclose the head portion, all in accordance with well-known practice.

In the construction of the body or panel portions 12 and 14, each is made up of an inner and outer shell layers 40 and 42, respectively, each layer preferably composed of a natural or synthetic fabric of fabric-like material formed into a plurality of generally rectangular strips 44 which extend transversely of the length of the bag and are sewn together along laterally extending seams 46. The seams in the inner and outer layers 12 and 14 are tucked inwardly by folding abutting edges of adjacent strips inwardly and stitching together specifically as represented at 50, all as set forth and described in my previously issued U.S. Pat. No. 3,805,720.

In addition, the bag may be constructed so that the inner and outer shell layers 40 and 42 for each of the upper and lower panel portions 12 and 14 are differentially cut; that is to say, the overall size of the inner layer 40 of each panel is of reduced size with respect to the outer layer 42 of each panel, the degree of increase being in relation to the amount of loft or separation desired between the layers, all as described in somewhat more detail by previously issued U.S. Pat. No. 3,857,125. Sleeping bags are customarily constructed so that the panel portions or layers on either side are spaced from one another by a fill material which will afford a maximum amount of loft so as to create maximum trapped air spaces between the layers for maximum or optimum insulation. At the same time, it is highly desirable that the bag be as lightweight and flexible as possible so as to facilitate storage into a compact size which can be easily transported or carried, for example, in backpacking or hiking. To this end, the upper and lower panel portions are provided with a novel form of high strength, interconnecting insulated plies 52 arranged to extend diagonally between the inner and outer shell layers 40 and 42 at spaced longitudinal intervals therealong. In the preferred form the plies 52 are in the form of rectangular strips of a length corresponding to the length of the rectangular strips 44 forming the shell layer but of an increased width sufficient to extend from connection along one longitudinal side edge 54 which is joined to an end seam 46 of the inner shell layer and an opposite longitudinal side edge 56 is secured to an end seam 46 of the outer shell layer which is two seams removed from that seam directly opposite to or aligned with the seam to which the longitudinal edge 54 is attached. In succession, each interconnecting layer 52 is attached to extend from an end seam of the inner shell layer to at least one seam removed on the outer shell layer so that the interconnecting layers are slanted and interconnected substantially in parallel to one another. As successive strips or insulating layers are interconnected in the manner described, and as particularly noted from FIGS. 2 to 4, the width of each layer is such as to overlap one-half the width of the next successive interconnecting layer so as to form a double thickness of insulating layers throughout when the outer shell layer is flattened against the inner shell layer as shown in FIG. 2. On the other hand, when the outer shell layer is spaced or non-compressed away from the inner shell layer, as shown in FIG. 4, air spaces 58 are formed between the insulating layers 50 to contribute to the insulating characteristics of the bag. In the manner described, the interconnecting layers when laid unidirectionally in overlapping relation to one another perform the dual function of reinforcing or baffle layers as well as insulating fill while providing the desired high loft characteristics in the bag.

Figure 5:
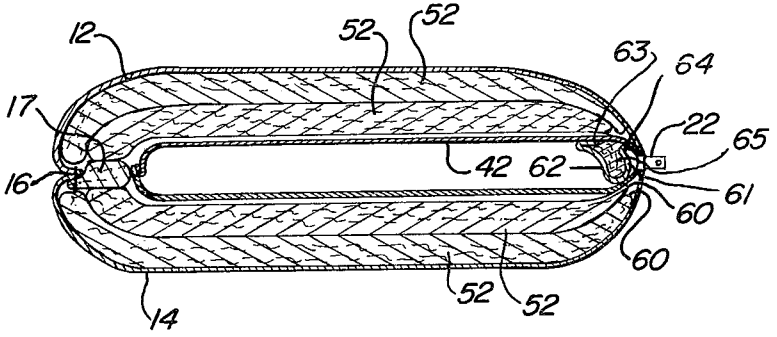
FIG. 5 is a transverse sectional view taken about lines 5—5 of FIG. 1.

As shown in FIG. 5, opposite end edges 60 of the insulating or interconnecting layers 52 abut the reinforcing or opposite side edges along the seam 16 and zipper section 22 of the bag. As further shown, a draft flap 61 extends along the zipper section 22 and consists of an elongated narrow strip 62 secured by stitching along opposite longitudinal edges 63 and 64 to the inner layer 42 of the upper panel section 12 contiguous to the zipper section 22 and enclosing an insulating ply 65 of reduced width. The interrelationship, as illustrated in FIG. 5, continues throughout the entire length of the zipper section 22 so as to contribute greatly to the insulating characteristics of the bag.

An improved form of foot portion has also been devised in which layers 44 encases plies 52 of insulating material as described, the layers 44 extending transversely of the length of the bag across the lower end portion in closely spaced relation to the foot portion and terminating just above the lower panel portion 14 so as to form a limited space generally designated at 66 in the foot area to permit placement of the feet in the end of the bag without cramping and while affording substantially complete insulation for them. Here, the shell layers 44 are seamed or stitched to an inner seam 46 of an inner shell layer and secured thereto from opposite sides of the upper panel portions.

Construction of interconnecting layers in the manner described is made possible by utilization of the high strength, continuous filament, synthetic fiber material sold under the trademark POLARGUARD by Celanese Corporation of America. It has the particular characteristics when used as an insulating material for sleeping bags and the like of possessing high strength so as to inhibit stretching or separation under tension without need for outer coverings of batting or other special high strength layers; and the opposite longitudinal edges can be stitched directly to the end seams without additional reinforcing material; yet the material possesses sufficient flexibility as to permit the bag to be tightly rolled or folded as desired and can be compressed for example from an expanded thickness as illustrated in FIG. 4 on the order of two inches to a reduced thickness as illustrated at its point of interconnection to the end seams of less than one-quarter inch.

Figure 6:
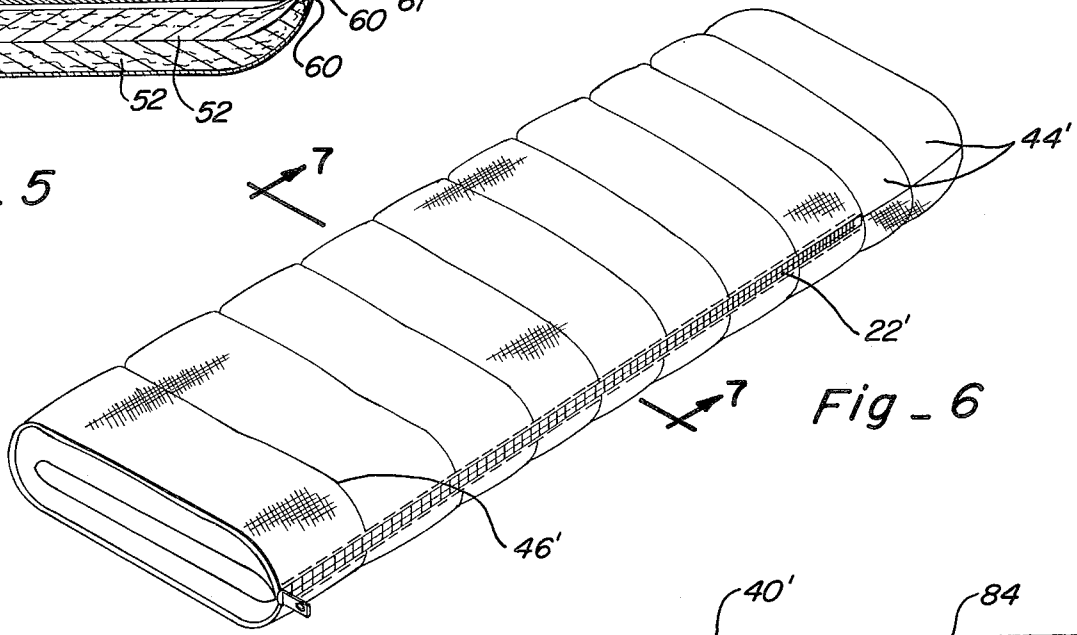
FIG. 6 is a somewhat perspective view of a modified form of sleeping bag incorporating an insulated covering in accordance with the present invention.
Figure 7:
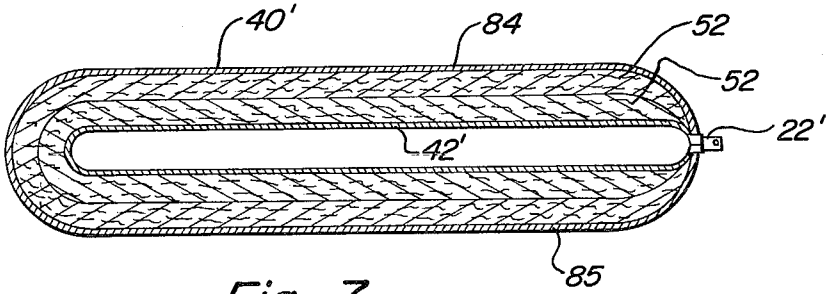
FIG. 7 is a cross-sectional view taken about lines 7—7 of FIG. 6.

A modified form of sleeping bag or insulated covering is illustrated in FIGS. 6 and 7 in which upper and lower panel portions 84 and 85 are defined by a single continuous length of material of rectangular configuration doubled upon itself to form the upper and lower panel sections. Once again inner and outer shell layers 40' and 42' have elongated rectangular strips 44' extending transversely of the length of the bag and sewn together along laterally extending seams 46' as in the preferred form. In addition, insulating plies 52 extend between end seams 46' as formerly described but in this form extend continuously from edge to edge along with the inner and outer shell layers so as to greatly simplify construction of the bag. Again, the mating longitudinal edges 90 are releasably interconnected by a zipper portion 22' which extends along the greater length of the mating edges to terminate adjacent to the foot section of the bag.

For the purpose of illustration and not limitation, in each form of invention the coextensive layers 40 and 42 as defined may have strips 44 having a width on the order of 5 to 6 inches whereas the width of the insulating plies are each on the order of 12 to 14 inches so as to be of a length to traverse two seam zones or strips 44 for interconnection and extension from a seam on the inner layer to the second seam removed therefrom on the outer layer. The thickness of each insulating ply may be on the order of one inch, but as noted is capable of compression or flattening, particularly along the seams, to a fraction of an inch on the order of 1/16th to $\frac{1}{8}$ of an inch.

Although the present invention has been described with particularity relative to the foregoing detailed description of an exemplary preferred embodiment, various modifications, additions, changes and applications other than those specifically mentioned herein will be readily apparent to those having normal skill in the art without departing from the spirit of this invention.

What is claimed is:

1. In an insulated covering comprising:

inner and outer coextensive layers secured together along their outer peripheral edges, and a plurality of flexible insulating plies interposed between said inner and outer layers, each ply having one side edge affixed to one of said coextensive layers and an opposite side edge affixed to the other of said layers, said insulating plies extending between said inner and outer layers in substantially parallel spaced apart relation to one another, and each insulating ply being composed of a resilient fill material being compressible in thickness having continuous filaments oriented in the lateral direction of extension of each ply from one side edge to the opposite side edge, each ply being of a width exceeding the distance separating adjacent plies so that each ply overlaps each next ply in succession to define plural insulating plies of substantially uniform thickness between said inner and outer coextensive layers when said layers are pressed inwardly toward one another, each pair of successive plies along with said inner and outer coextensive layers defining a chamber therebetween when said layers resiliently expand away from one another.

2. An insulated covering according to claim 1, each of said inner and outer coextensive layers comprised of elongated sections of a fabric-like material disposed in edge-to-edge abutting relation to one another along their longitudinal side edges, seams joining the abutting longitudinal side edges of said sections of fabric material, said seams extending in a direction parallel to the opposite side edges of said insulated plies.

3. An insulated covering according to claim 1, one side edge of each of said insulating plies being joined to a first seam of one of said layers and the opposite side edge joined to a second seam of the other layer which is at least two seams removed from that seam aligned with said first seam so that the insulating plies extend diagonally between said inner and outer layers in overlapping relation to one another.

4. An insulated covering according to claim 2, the abutting edges of said sections of fabric material being folded inwardly and joined to a side edge of an insulating ply subjacent the plane of the respective coextensive layer.

5. An insulated covering according to claim 4, each the thickness of side edge of an insulating ply being compressed and stitched together with abutting edges of adjacent sections of fabric material so as to lie generally flat and in parallel to one another.

6. An insulated covering according to claim 1 wherein said insulated plies are further characterized by consisting entirely of a polyester filamentary material in the form of a high loft, loose fill material possessed of high tensile strength in a direction normal to the side edges of the insulating plies whereby to resist stretching in a direction of applied force normal to the side edges of each insulation ply, each of said plies being compressible in thickness between a thickness on the order of one-fourth inch when compressed and a thickness exceeding two inches when expanded.

7. An insulated covering according to claim 1, each of said insulating plies being substantially coextensive in length and overlapping one-half of each next adjacent insulating ply.

8. In a sleeping bag, an insulated covering comprising inner and outer coextensive layers of fabric material secured together along their outer peripheral edges to define an elongated panel portion, and a plurality of flexible insulating plies extending between said inner and outer coextensive layers, each ply being a mat of loose resilient fill material compressible to at least one-half its thickness and having continuous filaments oriented in a direction to extend between opposite side edges of the insulating plies, one side edge of each ply attached to the inner surface of one of said coextensive layers and the opposite side edge of each ply attached to the inner surface of the other of said coextensive layers at a location which is substantially aligned with the location of attachment of the one side edge of the second ply removed therefrom, said insulating plies extending diagonally between said inner and outer coextensive layers in spaced parallel relation to one another along the length of said panel portion and said insulating plies being sized to overlap one another along the length of said panel portion and to define double insulating plies of substantially uniform thickness when said inner and outer coextensive layers are not expanded away from one another, and each pair of successive plies along with said inner and outer coextensive layers defining a chamber therebetween when said layers resiliently expand away from one another.

9. In a sleeping bag according to claim 8, each of said inner and outer coextensive layers being defined by elongated fabric strips disposed in edge-to-edge relation to one another in a direction normal to the length of the sleeping bag, adjoining edges of said strips being seamed together with a side edge of an insulating ply.

10. In a sleeping bag according to claim 8, each insulating ply overlapping at least one-half of each next insulating ply throughout the length of said covering.

11. In a sleeping bag according to claim 8, said insulated covering defined by upper and lower interconnected panel sections arranged in superimposed relation to one another, each panel section comprising said inner and coextensive layers, a zipper section interconnecting adjoining longitudinal side edges of said panel sections at least along one side, and a draft flap extending along said zipper section including an inner layer in the form of a narrow elongated strip having opposite side edges secured to the inner layer of one of said panel sections adjacent to said zipper section and an insulating ply sandwiched between said draft flap and panel section inner layers.

12. In a sleeping bag according to claim 8, said insulated covering defined by upper and lower interconnected panel sections arranged in superimposed relation to one another, each panel section comprising said inner and coextensive layers, said panel sections joined together along one end to define a vertically extending foot portion, and a vertically extending panel section connected to and extending downwardly from said upper panel section in adjacent spaced relation to said foot portion.

13. In a sleeping bag according to claim 12, said vertically extending panel section defined by outer layers of a fabric or fabric-like material and insulating plies sandwiched between said outer layers in overlapping relation to one another.

14. In a sleeping bag according to claim 11, the adjoining sides of said panel sections opposite to said zipper section having a common baffle section extending therebetween, said baffle section including spaced layers of a fabric-like material and an insulating ply sandwiched therebetween.

* * * * *